US005730666A

United States Patent [19]

Hudson

[11] Patent Number: 5,730,666

[45] Date of Patent: Mar. 24, 1998

[54] PORTABLE SCREEN

[75] Inventor: Glenn E. Hudson, Heyworth, Ill.

[73] Assignee: Retail Systems, Ltd., Heyworth, Ill.

[21] Appl. No.: 672,062

[22] Filed: Jun. 26, 1996

[51] Int. Cl.[6] ..... A63B 69/40

[52] U.S. Cl. ..... 473/421

[58] Field of Search ..... 273/26 A, 410, 273/127 B, 127 A; 135/129, 134, 139, 148, 151, 154

[56] References Cited

U.S. PATENT DOCUMENTS 2,014,336 9/1935 Marthaler .
2,633,319 3/1953 Musial ..... 354/293

FOREIGN PATENT DOCUMENTS 2302062 9/1976 France ..... 135/132

*Primary Examiner*—Theatrice Brown
*Attorney, Agent, or Firm*—Michael Berns

[57] ABSTRACT

A portable and collapsible screen unfolds and extends to provide a wall, divider or backstop which has many uses. The screen can be used as a backstop for ball games, a wind block, a privacy screen, or anywhere a small divider, screen or barricade is needed. Two base poles support a main pole where all the poles extend telescopically and a screen is attached to the far ends of the extended main poles. Anchoring means and floor base means are connected to the poles. Additional frame members and nets can be attached to extend the screen and form various shapes.

7 Claims, 8 Drawing Sheets

PORTABLE SCREEN

FIELD OF THE INVENTION

The invention relates to a collapsible, portable screen which one person can easily erect and use as a backstop, shield, partition or screen for use in athletics, industry, construction, and other areas.

DESCRIPTION OF THE PRIOR ART

There are a wide variety of portable partitions for sports, business, construction, and personal use. The most common use is in the field of sports. Similar devices are used to stop golf balls, soccer balls, basketballs, or baseballs.

Many sports require the use of balls and there is often a need to keep the balls in the field of play. Nets are placed behind the catcher in baseball, and practice nets are often used to stop the flight of a ball. The game of soccer can be practiced by kicking balls into a net that damps the trajectory of and stops the balls so that retrieval is not a problem. In order to block a high percentage of the balls, these nets need to be broad, and this normally requires the erection of large poles and frames.

Most of the previous screens for these uses employed rigid rectangular frames which provided a good blocking area, but lacked the ability to fold easily or collapse the device into a portable size. Prior products are either unwieldy, costly, heavy, difficult for one person to assemble or disassemble and/or too small. A major benefit of this invention is the ability for one person to quickly collapse the portable screen to a size that will fit in a car trunk. This allows the portable screen to be carried to parks and picnics where a parent can play a game with a child and not spend time chasing game balls. U.S. Pat. No. 2,839,300 to Blaha et al. (1958) discloses a "Baseball Batting Practice Device" with a flexible material screening supported by a frame structure. This device is not portable and requires much more framework. The screen is rectangular and hung from a horizontal frame piece.

U.S. Pat. No. 2,986,398 to Oliver (1961) discloses a "Practice Backstop for Golfers" which has a large rectangular blocking area that is supported by a frame.

U.S. Pat. No. 3,184,235 to Hilbrich (1965) discloses a "Portable Collapsible Backstop for Baseball Practice" which has a rectangular net supported by an umbellate frame.

U.S. Pat. No. 3,856,301 to Davidson (1974) discloses a "Portable Ball Stop" which has a net similar to U.S. Pat. No. 3,184,235. The frame is made up of six legs which fold together for transporting.

U.S. Pat. No. 4,127,267 to Bay and DiMarco (1978) discloses a collapsible frame with a net for arresting balls. This system is not easily erected and requires a large, flat area behind the net. The frame has two base legs and two supporting arms that hold the corners of a rectangular net. This is the most portable of the prior net frames.

U.S. Pat. No. 5,407,211 to Bottiglieri (1995) discloses a sports net that is adjustable. The rectangular frame is an improvement on the standard sports net, but it does not collapse easily for transporting.

The above backstops and practice devices suffer from several disadvantages. They are either heavy, difficult for one person to assemble or disassemble, too small for multiple sport usages, or very costly to construct.

In contrast to the prior art devices, the present invention provides a large net area with the least frame structure. This allows the greatest portability and smallest size. Further, the present invention offers the advantage of requiring no tools or ladders to set up. Also, one person or child can easily and quickly erect and take down this invention for use at almost any location without any additional requirements being necessary.

SUMMARY OF THE INVENTION

The present invention provides a portable wall for use in a number of applications. The primary need for such a product is in the practice of athletic activities such as baseball, golf, basketball, softball, or soccer. The screen can be used with netting or any flexible fabric depending on the required use. An opaque fabric would make an easily transportable visual barrier for screening. A reflective fabric on the frame would assist photographers in providing light on a subject. A canvas screen could be used to partition off areas of construction.

It is an object of the invention to provide an economical, lightweight, portable, collapsible backstop that can be easily and quickly erected and disassembled by one person. The device is unique in that it provides a large backstop or screen, while it is easily assembled and disassembled by one person, and can fit it into an average automobile trunk.

This invention uses a hinged combination of three telescoping poles with a net or fabric attached between the distant ends of the poles that spans to form a large triangular shaped backstop or screen. The middle pole of the three poles has two shorter poles that are attached near its midpoint when extended. These two support poles have stakes attached to their ends and open up to provide support for the middle pole in its upright position when the backstop is opened for use on dirt, sand, or any other penetrable surface. "U" shaped pins can also be used to secure the two base poles to the ground. For use of the invention on a hard surface, such as concrete, or a gymnasium floor, the stakes can be removed and replaced with flat, skid-resistant weights.

The main pole, base poles, and support arms can be telescoped together and then the base poles and support arms can be folded upward along the main pole to make a compact shape which is easily carried. The net or fabric can be folded with the poles or removed for transportation.

BRIEF DESCRIPTION OF THE DRAWINGS

The present invention will be more fully understood by reference to the following detailed description thereof when read in conjunction with the attached drawings, and wherein.

Figure 1:
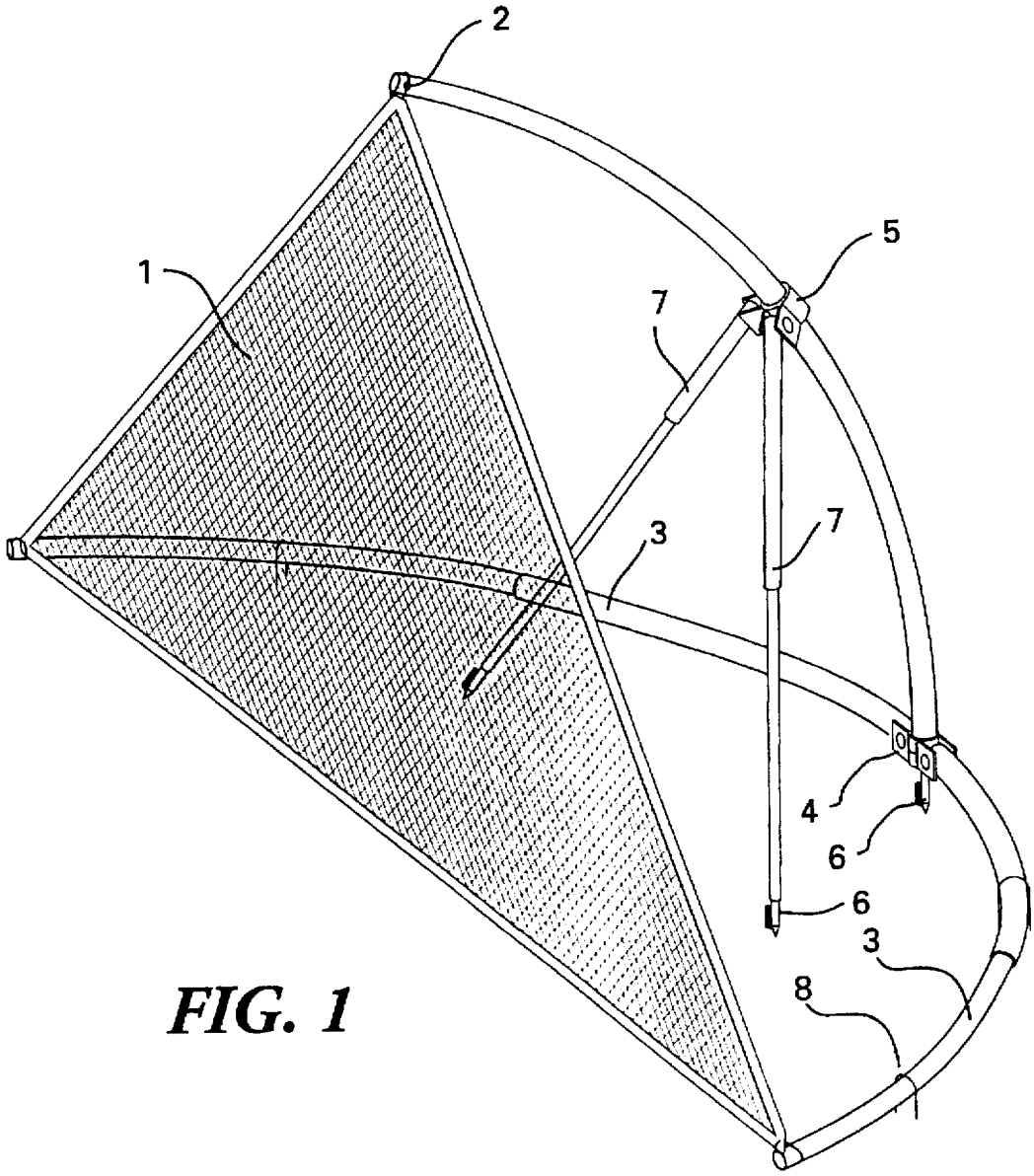
FIG. 1 is an illustration of the invention in the fully extended and operable position.
Figure 2:
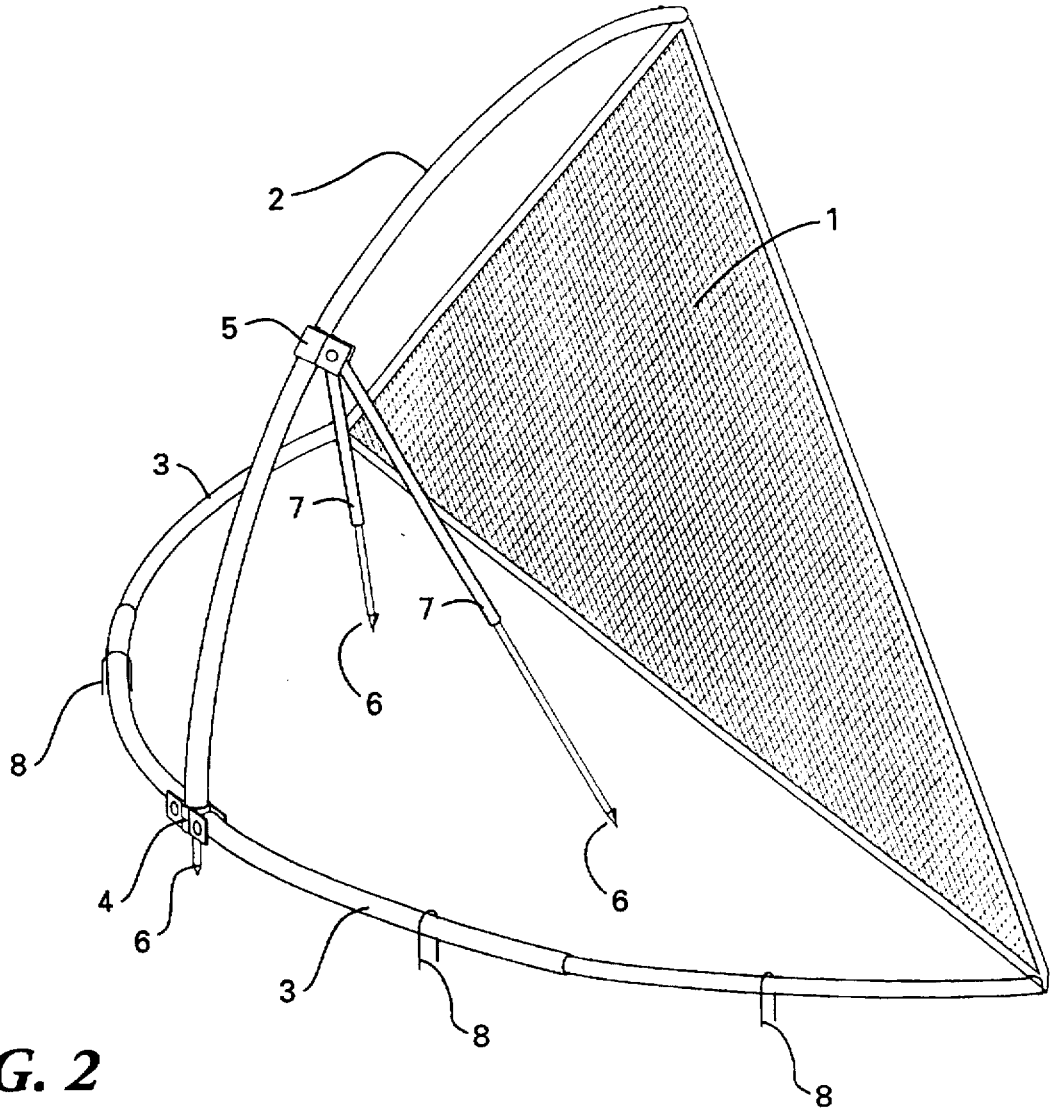
FIG. 2 is an illustration of the invention from the back side.
Figure 3:
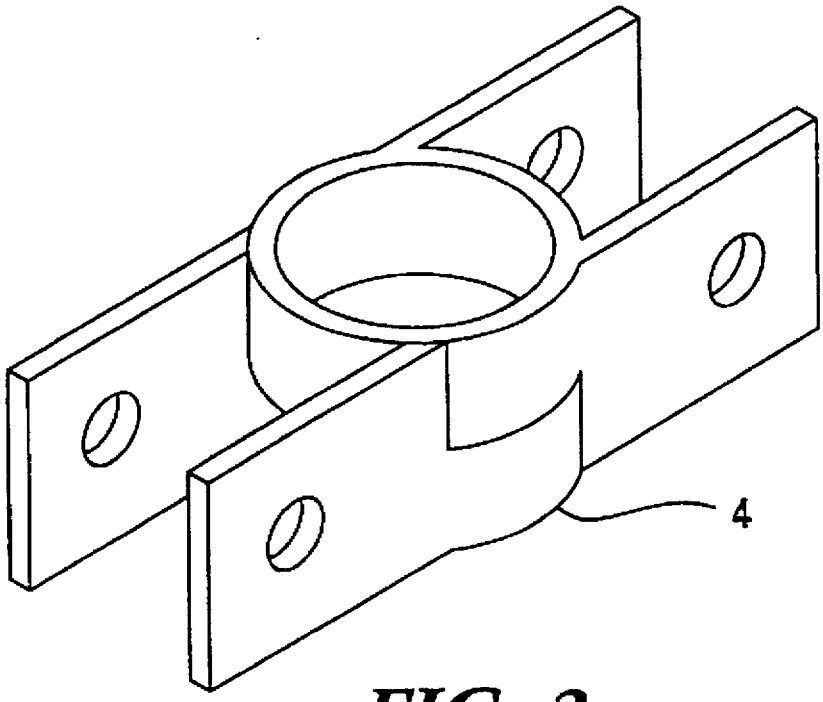
FIG. 3 is a detail drawing of the main hinge.
Figure 4:
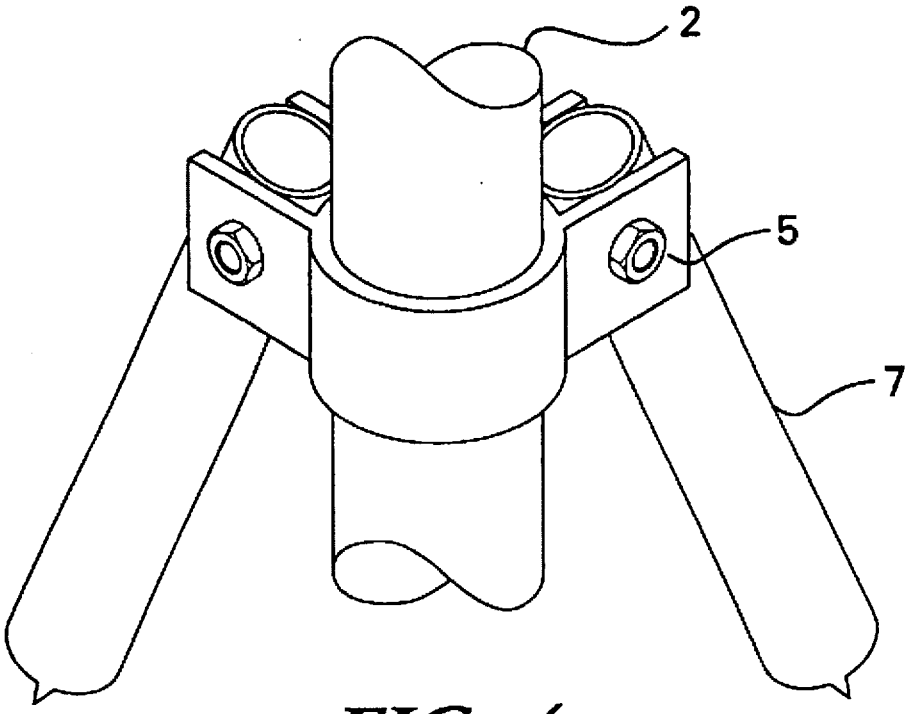
FIG. 4 is a detail drawing of the support hinge from the front of the invention.

REFERENCE NUMERALS IN THE DRAWINGS 1 screen
2 main pole 3 base poles
4 main hinge
5 support hinge
6 stakes
7 support legs
8 anchor
9 floor base

DETAILED DESCRIPTION OF THE DRAWINGS

A typical embodiment of the portable screen of the present invention, as it is fully extended and set up for use, is illustrated in FIG. 1. A large screen 1 extends between the main pole 2 and the ends of the base poles 3. The main pole 2 and the base poles 3 extend telescopically to create a large frame from a relatively small collapsed size. The screen 1 should be sized to provide the desired tautness when the main pole 2 and base poles 3 are extended.

In the preferred embodiment, the screen 1 is a netting material which can absorb the impact of large objects, such as basketballs yet hold small objects such as golf balls. The netting can consist of any other flexible material that can be folded or rolled up, such as cloth, nylon mesh, cotton netting, camouflage material, leather, rubber, vinyl, etc. The type of netting used will impact the application of the uses for the portable screen. Mesh material will be best for most uses as an athletic barrier. Opaque material for the netting will create a visual screen. Reflective cloth would assist photographers in providing light on a subject. A canvas fabric can be used as a barrier to partition off a construction area. Replacement of the screen material allows a wide range of uses for the portable screen.

The frame components 2, 3 are made of a substantial but lightweight structural framing members. Repeated pounding by objects like baseballs would require a strong and durable material. Fiberglass, metal, and plastic could be used. To further protect the main pole 2, the main pole 2 and the base poles 3 can be curved or bended toward the screen 1, where gravity would draw the screen 1 away from the main pole 2. This would allow the force of the object to be absorbed by the screen 1 and not impact the frame members 2,3.

For stability when used outdoors, it is preferred to add a series of anchors 8. A number of these anchors 8, made of U-shaped pins, can straddle the base poles 3 and be driven into the ground. Stakes 6 on the bottom of the main pole 2 and the support legs 7 can be driven into the ground to hold the portable screen securely, so that it will not move during repeated use or when hit off-center.

Adapting the invention for indoor use, or on a hard surface, requires a few accessories. The stakes 6 are removed from the ends of the support legs 7 and the main pole 2. A floor base 9 is inserted into the ends of the poles. The floor base 9 has a flat surface which may have a skid resistant coating.

Figure 5:
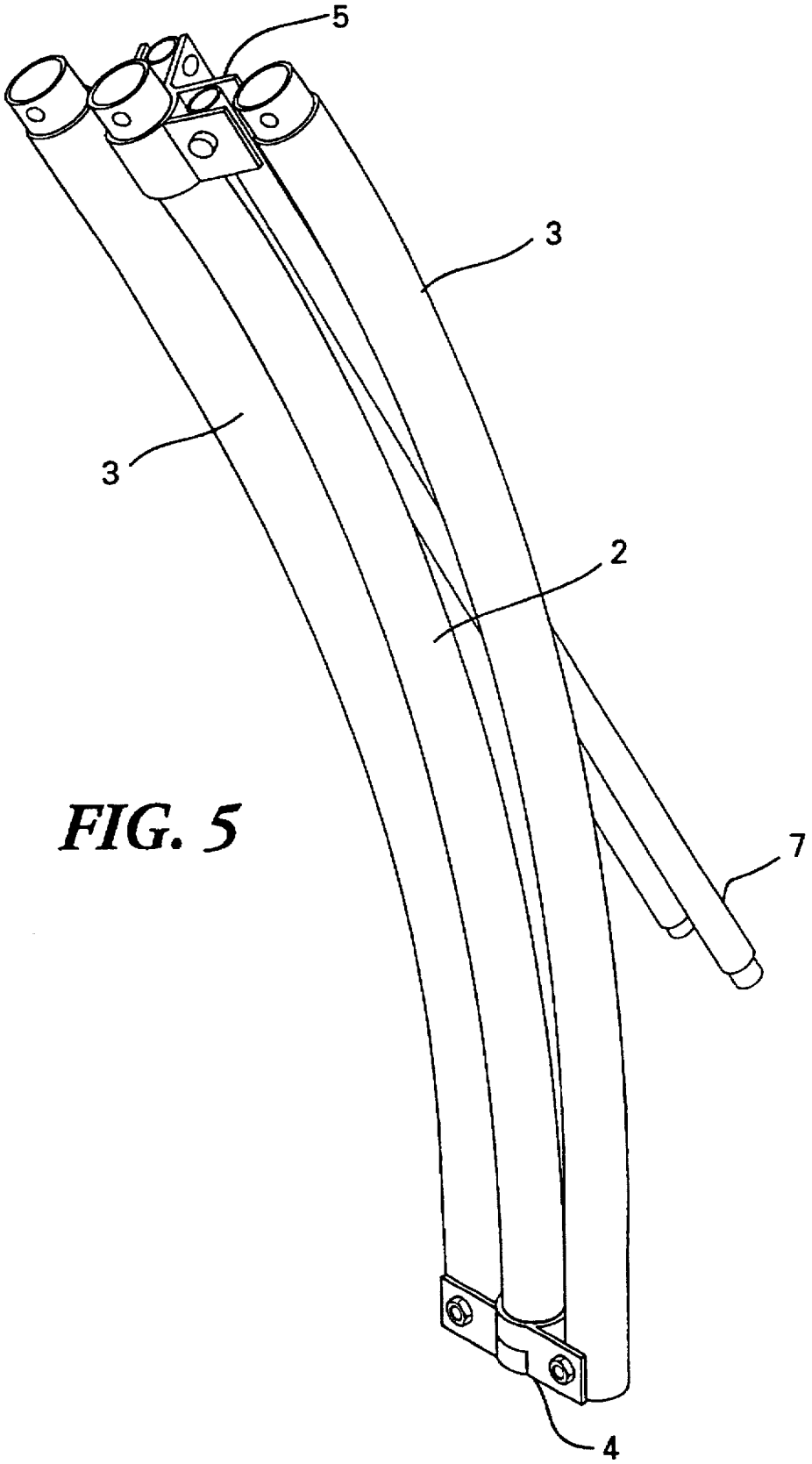
FIG. 5 is an illustration of the invention in the collapsed and folded position with the screen removed.
Figure 6:
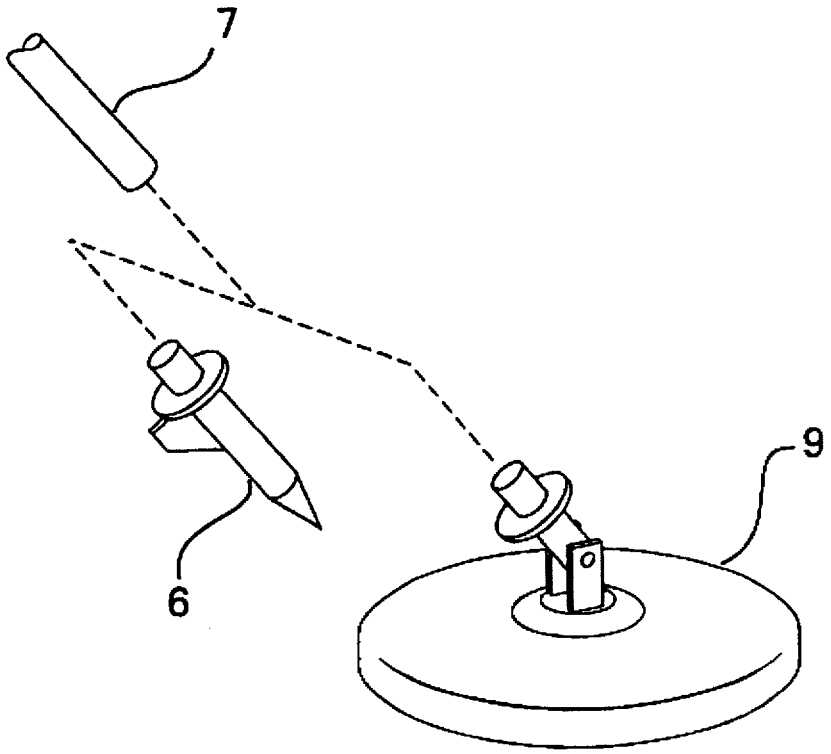
FIG. 6 is a detail of the optional support base for use on a hard surface.
Figure 7:
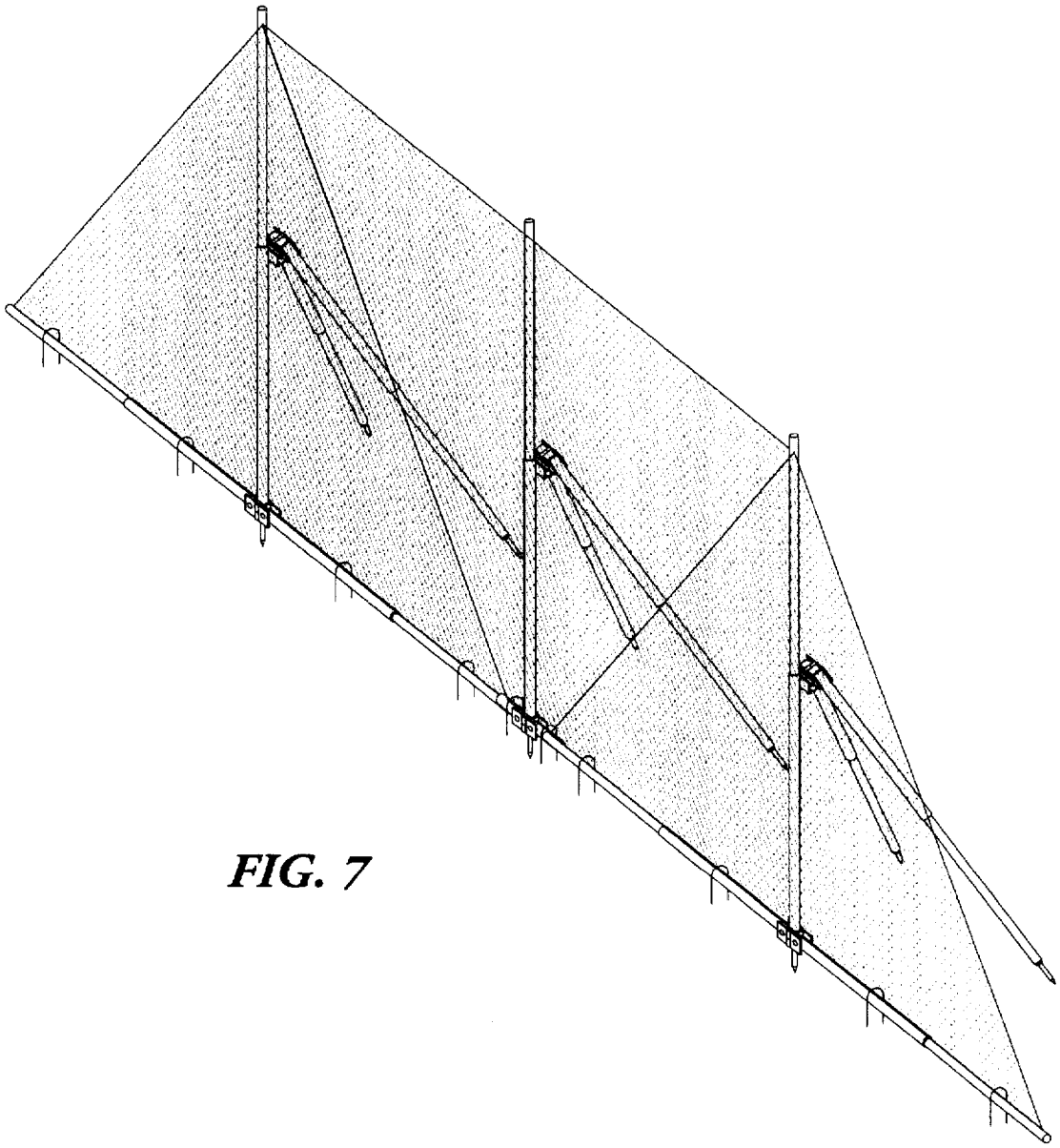
FIG. 7 is an illustration of the invention with multiple units forming a screen wall.
Figure 8:
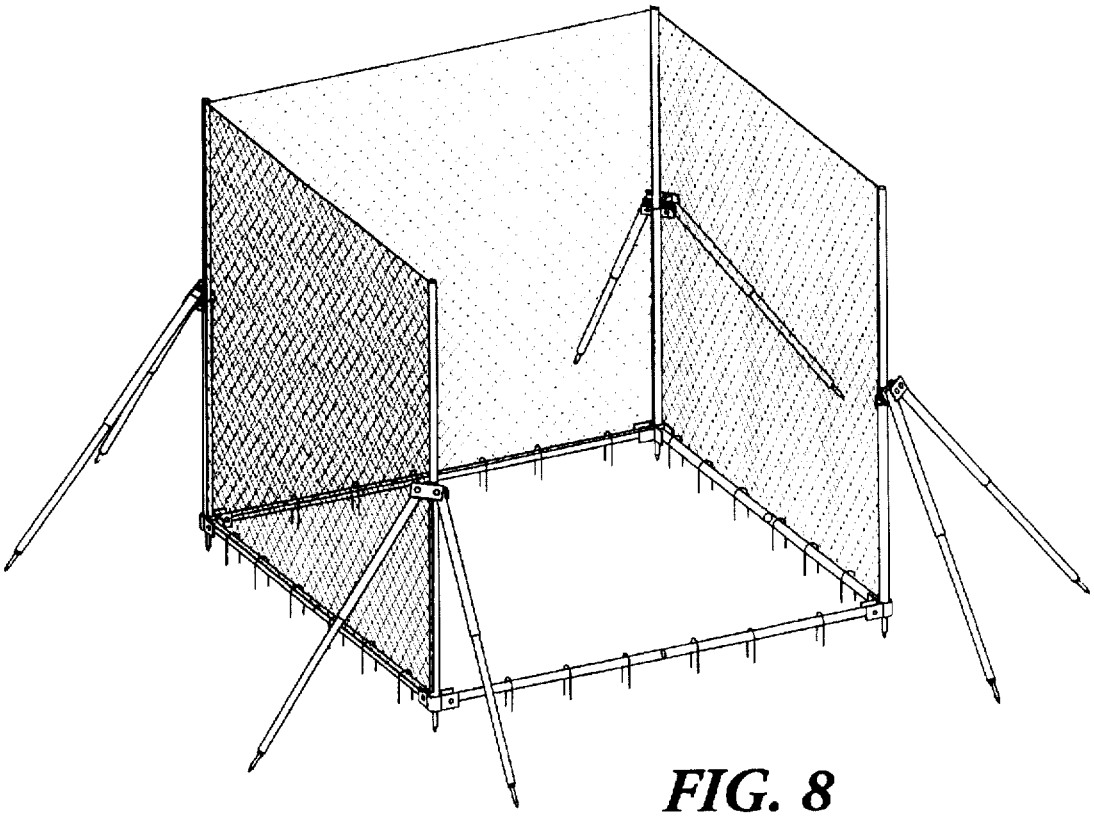
FIG. 8 is an illustration of the invention with multiple units forming a three sided enclosure.

Erecting the invention is simple. From the collapsed position as shown in FIG. 5, the base poles 3 are first rotated away from the main pole 2 and then extended to their full length. With the main pole 2 leaning back toward the support legs 7, the main pole 2 is extended and then rotated to a vertical position. The main hinge 4 swivels around the main pole 2 so the base poles 3 can rotate to a multitude of positions allowing the screen 1 to be used in a variety of flexible positions. The support legs 7 are then rotated away from the main pole 2 and extended to the ground. On a grass or dirt surface, the stakes 6 should then be pushed into the ground and anchors 8 attached to the base poles 3. To disassemble, the invention, the steps are merely reversed. The screen 1 may also be removed for transportation Derivations of the invention could provide additional uses. Expanding the invention by adding additional framing pieces and nets creates a screening fence, as shown in FIG. 7. Adding a unit of the invention that does not have base poles, between two complete units and adding an additional net, creates a fence that can be extended to any length. A tent-like enclosure could be created by rotating the base poles 3 to a right angle and adding two units, without base poles 3, and rectangular nets. This configuration could form an enclosure for a shelter, privacy area, or other similar use. By removing one side of the box, a batting cage could be created, as shown in FIG. 8.

It is not desired to limit the invention to the exact construction and operation shown and described, and accordingly all suitable modifications and equivalents may be resorted to, falling within the scope of the invention as claimed.

I claim:

1. A portable and collapsible screen comprising:

A hinged combination of three poles, a main hinge connecting two outer poles to a middle pole; a screen attached to said three poles at the end of each pole opposite said main hinge; a collar attached to and rotatable around said middle pole; two support legs pivotally attached to said collar, such that said support legs can be angled away from said two outer poles to brace said middle pole; and means for anchoring said outer poles, said middle pole and said support legs, whereby said screen forms a substantially upright position.

2. The portable and collapsible screen according to claim 1, wherein the three poles and two support legs are telescopically extended.

3. The portable and collapsible screen according to claim 1, wherein the three poles are curved.

4. The portable and collapsible screen according to claim 1, wherein the means for anchoring the outer poles and support legs is with weights and a flat skid-resistant surface, whereby the invention may be used on a hard surface without damaging said screen surface.

5. The portable and collapsible screen according to claim 1, having spikes at the ends of the support poles opposite the middle pole, whereby the spikes provide a means for anchoring said screen to the ground.

6. The portable and collapsible screen according to claim 1, having sockets in the poles which receive means for anchoring said screen.

7. The portable and collapsible screen according to claim 1, having the middle pole and outer poles curved to form a concave shape, whereby the net is hung away from the poles.

* * * * *